US006446438B1

(12) United States Patent
Kraft et al.

(10) Patent No.: US 6,446,438 B1
(45) Date of Patent: Sep. 10, 2002

(54) COMBUSTION CHAMBER/VENTURI COOLING FOR A LOW NOX EMISSION COMBUSTOR

(75) Inventors: Robert J. Kraft, Palm City; Vincent C. Martling, West Palm Beach; Brian R. Mack, Palm City; Mark A. Minnich, West Palm Beach, all of FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 0 days.

(21) Appl. No.: 09/605,765

(22) Filed: Jun. 28, 2000

(51) Int. Cl.[7] ..... F23R 3/30
(52) U.S. Cl. ..... 60/737; 60/760
(58) Field of Search ..... 60/39.02, 737, 60/760

(56) References Cited

U.S. PATENT DOCUMENTS 2,244,467 A * 6/1941 Lysholm ..... 60/760
2,446,059 A * 7/1948 Peterson et al. ..... 60/760
RE23,149 E * 9/1949 Lubbock et al. ..... 60/260

* cited by examiner

*Primary Examiner*—Louis J. Casaregola
(74) *Attorney, Agent, or Firm*—Malin, Haley & DiMaggio, P.A.

(57) ABSTRACT

A method and apparatus for providing air cooling to the venturi and the combustion chamber in a low NOx emission combustor as used in a gas turbine engine that includes providing an annular air passage surrounding said combustion chamber and venturi where said cooling air enters the combustion chamber/venturi near the aft portion of the combustion chamber passing the air along the combustion chamber, past the venturi where the air exits near the front portion of the convergent area of the venturi. The structure prevents any channel/passage cooling air from being received into the combustion chamber at the same time introducing the outlet of the cooling air after it has passed over the combustion chamber of the venturi and been heated back into the premix chamber thereby improving the efficiency of the combustor while reducing and lowering NOx emission in the combustion process.

5 Claims, 6 Drawing Sheets

COMBUSTION CHAMBER/VENTURI COOLING FOR A LOW NOX EMISSION COMBUSTOR

BACKGROUND OF THE INVENTION

1. Field of the Invention

This invention relates generally to an apparatus and method for cooling the combustion chamber and venturi used in a gas turbine engine for reducing nitric oxide emissions. Specifically an apparatus is disclosed for cooling the combustion chamber/venturi to lower nitric oxide (NOx) emissions by introducing preheated cooling air into the premix chamber for use in the combustion process.

2. Description of Related Art

The present invention is used in a dry, low NOx gas turbine engine typically used to drive electrical generators. Each combustor includes an upstream premix fuel/air chamber and a downstream combustion chamber separated by a venturi having a narrow throat constriction that acts as a flame retarder. The invention is concerned with improving the cooling of the combustion chamber which includes the venturi walls while at the same time reducing nitric oxide emissions.

U.S. Pat. No. 4,292,801 describes a gas turbine combustor that includes upstream premix of fuel and air and a downstream combustion chamber.

U.S. Pat. No. 5,117,636 and U.S. Pat. No. 5,285,631 deal with cooling the combustion chamber wall and the venturi walls. The patents state that there is a problem with allowing the cooling air passage to dump into the combustion chamber if the passage exit is too close to the venturi throat. The venturi creates a separation zone downstream of the divergent portion which causes a pressure difference thereby attracting cooling air which can cause combustion instabilities. However, it is also essential that the venturi walls and combustion chamber wall be adequately cooled because of the high temperatures developed in the combustion chamber.

The present invention eliminates the problem discussed in the prior art because the cooling circuit for the venturi has been adjusted such that the cooling air no longer dumps axially aft and downstream of the venturi throat into the combustion zone. In fact, cooling air flows in the opposite direction so that the air used for cooling the combustion chamber and the venturi is forced into the premix chamber upstream of the venturi, improving the efficiency of the overall combustion process while eliminating any type of cooling air recirculation separation zone aft of the venturi as discussed in the U.S. Pat. No. 5,117,636.

Recent government emission regulations have become of great concern to both manufacturers and operators of gas turbine combustors. Of specific concern is nitric oxide (NOx) due to its contribution to air pollution.

It is well known that NOx formation is a function of flame temperature, residence time, and equivalence ratio. In the past, it has been shown that nitric oxide can be reduced by lowering flame temperature, as well as the time that the flame remains at the higher temperature. Nitric Oxide has also been found to be a function of equivalence ratio and fuel to air (f/a) stoichiometry. That is, extremely low f/a ratio is required to lower NOx emissions. Lowering f/a ratios do not come without penalty, primarily the possibility of "blow-out". "Blow-Out" is a situation when the flame, due to its instability, can no longer be maintained. This situation is common as fuel-air stoichiometry is decreased just above the lean flammability limit. By preheating the premix air, the "blow-out" flame temperature is reduced, thus allowing stable combustion at lower temperatures and consequently lower NOx emissions. Therefore, introducing the preheated air is the ideal situation to drive f/a ratio to an extremely lean limit to reduce NOx, while maintaining a stable flame.

In a dual-stage, dual-mode gas turbine system, the secondary combustor includes a venturi configuration to stabilize the combustion flame. Fuel (natural gas or liquid) and air are premixed in the combustor premix chamber upstream of the venturi and the air/fuel mixture is fired or combusted downstream of the venturi throat. The venturi configuration accelerates the air/fuel flow through the throat and ideally keeps the flame from flashing back into the premix region. The flame holding region beyond the throat in the venturi is necessary for continuous and stable fuel burning. The combustion chamber wall and the venturi walls before and after the narrow throat region are heated by the combustion flame and therefore must be cooled. In the past, this has been accomplished with back side impingement cooling which flows along the back side of the combustion wall and the venturi walls where the cooling air exits and is dumped into combustion chamber downstream of the venturi.

The present invention overcomes the problems provided by this type of air cooling passage by completely eliminating the dumping of the cooling air into the combustion zone downstream of the venturi. The present invention does not permit any airflow of the venturi cooling air into the downstream combustion chamber whatsoever. At the same time the present invention takes the cooling air, which flows through an air passageway along the combustion chamber wall and the venturi walls and becomes preheated and feeds the cooling air upstream of the venturi (converging wall) into the premixing chamber. This in turn improves the overall low emission NOx efficiency.

BRIEF SUMMARY OF THE INVENTION

An improved apparatus for cooling a combustion chamber wall having a flame retarding venturi used in low nitric oxide emission gas turbine engines that includes a gas turbine combustor having a premixing chamber and a secondary combustion chamber and a venturi, a cooling air passageway concentrically surrounding said venturi walls and said combustion chamber wall. A plurality of cooling air inlet openings into said cooling air passageway are disposed near the end of the combustion chamber.

The combustion chamber wall itself is substantially cylindrical and includes the plurality of raised ribs on the outside surface which provide additional surface area for interaction with the flow of cooling air over the combustion cylinder liner. The venturi walls are also united with the combustion chamber and include a pair of convergent/divergent walls intricately formed with the combustion chamber liner that includes a restricted throat portion. The cooling air passes around not only the cylindrical combustion chamber wall but both walls that form the venturi providing cooling air to the entire combustor chamber and venturi. As the cooling air travels upstream toward the throat, its temperature rises.

The cooling air passageway is formed from an additional cylindrical wall separated from the combustion chamber wall that is concentrically mounted about the combustion chamber wall and a pair of conical walls that are concentrically disposed around the venturi walls in a similar configuration to form a complete annular passageway for air to flow around the entire combustion chamber and the entire venturi. The downstream end of the combustion chamber and the inlet opening of the cooling air passageway are separated by a ring barrier so that none of the cooling air in the passageway can flow downstream into the combustion chamber, be introduced downstream of the combustion chamber, or possibly travel into the separated region of the venturi. In fact the cooling air outlet is located upstream of the venturi and the cooling air flows opposite relative to the combustion gas flow, first passing the combustion chamber wall and then the venturi walls. The preheated cooling air is ultimately introduced into the premix chamber, adding to the efficiency of the system and reducing nitric oxide emissions with a stable flame.

The source of the cooling air is the turbine compressor that forces high pressure air around the entire combustor body in a direction that is upstream relative to the combustion process. Air under high pressure is forced around the combustor body and through a plurality of air inlet holes in the cooling air passageway near the downstream end of the combustion chamber, forcing the cooling air to flow along the combustor outer wall toward the venturi, passing the throat of the venturi, passing the leading edge of the venturi wall where there exists an outlet air passageway and a receiving channel that directs air in through another series of inlet holes into the premix chamber upstream of the venturi throat. With this flow pattern, it is impossible for cooling air to interfere with the combustion process taking placing in the secondary combustion chamber since there is no exit or aperture interacting with the secondary combustion chamber itself. Also as the cooling air is heated in the passageway as it flows towards the venturi and is introduced into the inlet premix chamber upstream of the venturi, the heated air aides in combustor efficiency to reduce pollutant emissions.

The outer combustor housing includes an annular outer band that receives the cooling air through outlet apertures upstream of the venturi. The air is then directed further upstream through a plurality of inlet air holes leading into the premix chamber allowing the preheated cooling air to flow from the air passageway at the leading venturi wall into the premix area.

The combustion chamber wall includes a plurality of raised rings to increase the efficiency of heat transfer from the combustion wall to the air, giving the wall more surface area for air contact. Although a separate concentric wall is used to form the air cooling passageway around the combustion chamber and the venturi, it is possible in an alternative embodiment that the outer wall of the combustor itself could provide that function.

It is an object of the present invention to reduce nitric oxide (NOx) emissions in a gas turbine combustor system while maintaining a stable flame in a desired operating condition while providing air cooling of the combustion chamber and venturi.

It is another object of this invention to provide a low emission combustor system that utilizes a venturi for providing multiple uses of cooling air for the combustor chamber and venturi.

And yet another object of this invention is to lower the "blow-out" flame temperature of the combustor by utilizing preheated air in the premixing process that results from cooling the combustion chamber and venturi.

In accordance with these and other objects, which will become apparent hereinafter, the instant invention will now be described with particular reference to the accompanying drawings.

DETAILED DESCRIPTION OF THE PREFERRED EMBODIMENT

Figure 1:
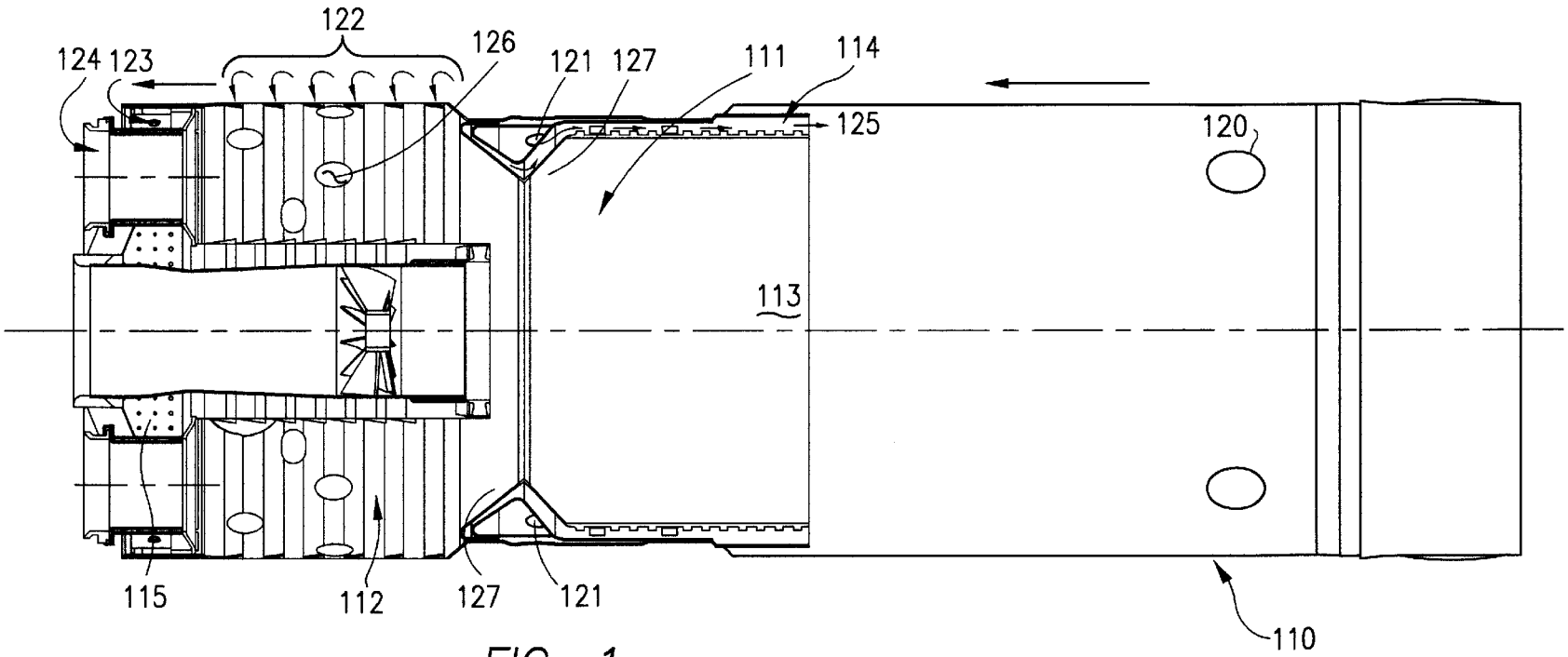
FIG. 1 PRIOR ART
FIG. 1 shows a side elevational view in cross-section of a gas turbine combustion system that represents the prior art, which shows an air cooling passage that empties into and around the combustion chamber.

Referring to FIG. 1, an existing gas turbine combustor well known in the prior art 110 is shown. The combustor 110 includes a venturi 111, a premixing chamber 112 for premixing air and fuel, a combustor chamber 113 and a combustion cap 115. As shown in this prior art combustor, cooling air represented by arrows flows under pressure along the external wall of the venturi 111. The cooling air enters the system through multiple locations along the liner 110. A portion of the air enters through holes 120 while the remainder runs along the outer shell. The cooling air, which is forced under pressure, with the turbine compressor as the source, enters the system through a plurality of holes 121. As seen in FIG. 1 the cooling air impinges and cools the convergent/divergent walls 127 of the venturi 111, which are conically shaped and travel downstream through the cylindrical passageway 114 cooling the walls of combustion cylinder chamber 113. The cooling air exits along the combustion chamber wall through annular discharge opening 125. This air is then dumped to the downstream combustion process. A portion of the cooling air also enters the premixing zone through holes 126. The remaining cooling air proceeds to the front end of the liner where it enters through holes 123 and the combustion cap 115. The portion of the cooling air that does not enter through holes 123 enters and mixes the gas and fuel through area 124. U.S. Pat. No. 5,117,636 discusses the prior art configuration of the venturi shown in FIG. 1. Problems are discussed regarding the cooling air exiting adjacent the venturi 111 through passage exit 125 which interferes with the combustion process and mixture based on what the '636 patent states as a separation zone.

The present invention completely alleviates any of the problems raised in the '636 patent.

Figure 2:
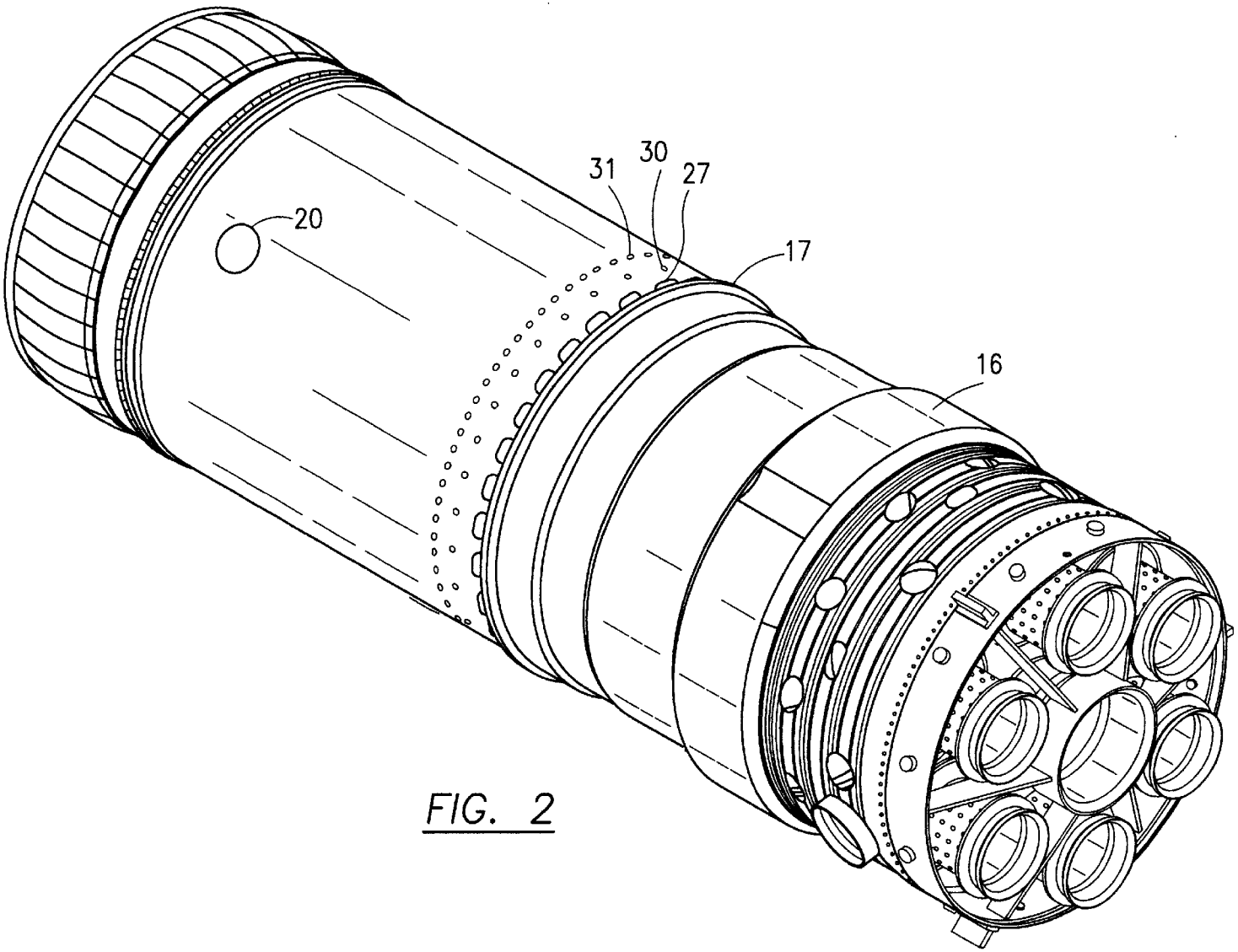
FIG. 2 shows a gas turbine combustion system in a perspective view in accordance with the present invention.
Figure 3:
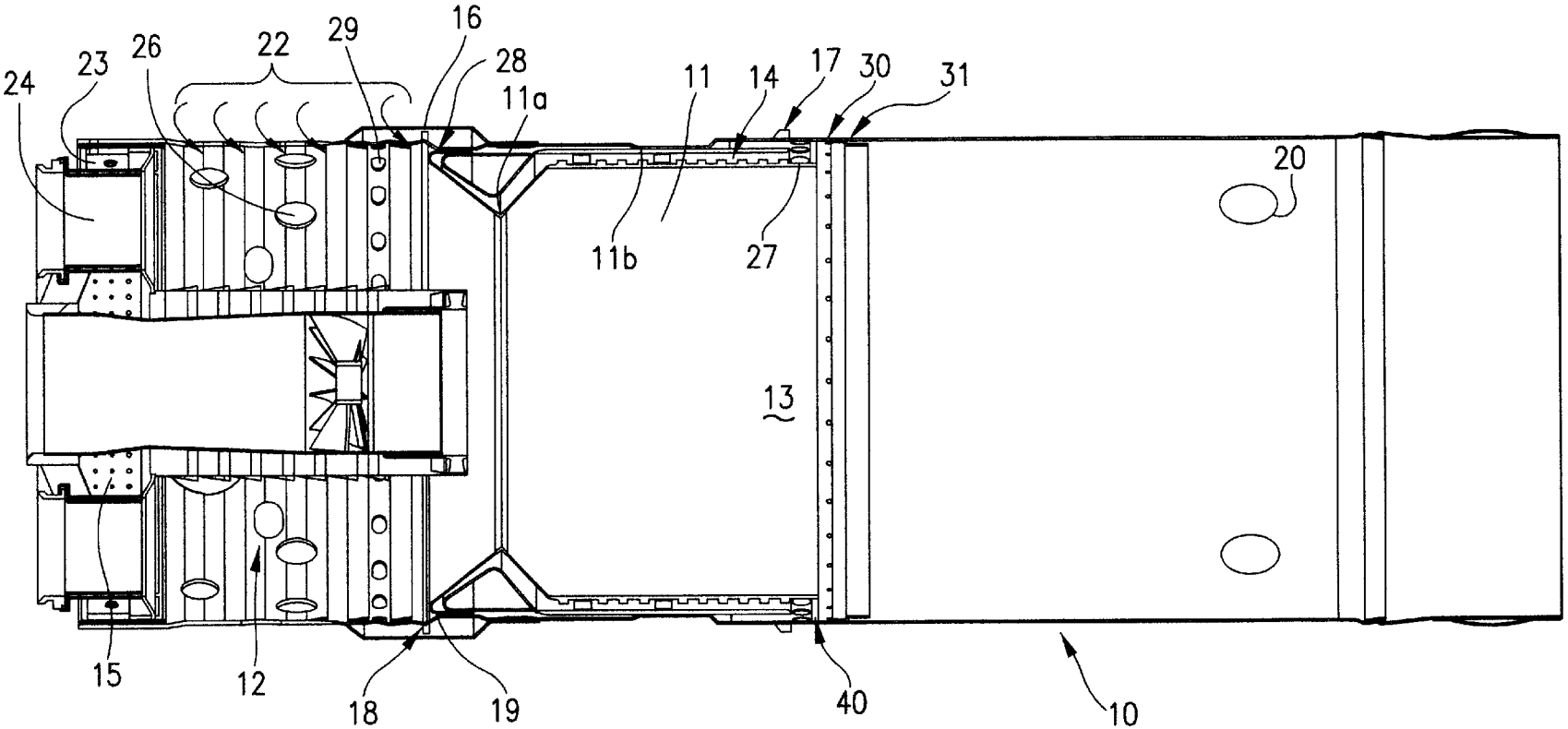
FIG. 3 shows a side elevational view in cross-section of a gas turbine combustor system in accordance with the present invention.

Referring now to FIGS. 2 and 3, the present invention is shown as gas turbine combustor 10 including a venturi 111.

The venturi 11 includes a cylindrical portion which forms the combustor chamber 13 and unitarily formed venturi walls which converge and diverge in the downstream direction forming an annular or circular restricted throat 11*a*. The purpose of the venturi and the restricted throat 11*a* is to prevent flash back of the flame from combustion chamber 13.

A concentric, partial cylindrical wall 11*b* surrounds the venturi 11 including the converging and diverging venturi walls to form an air passageway 14 between the venturi 11 and the concentric wall 11*b* that allows the cooling air to pass along the outer surface of the venturi 11 for cooling.

Figure 5:
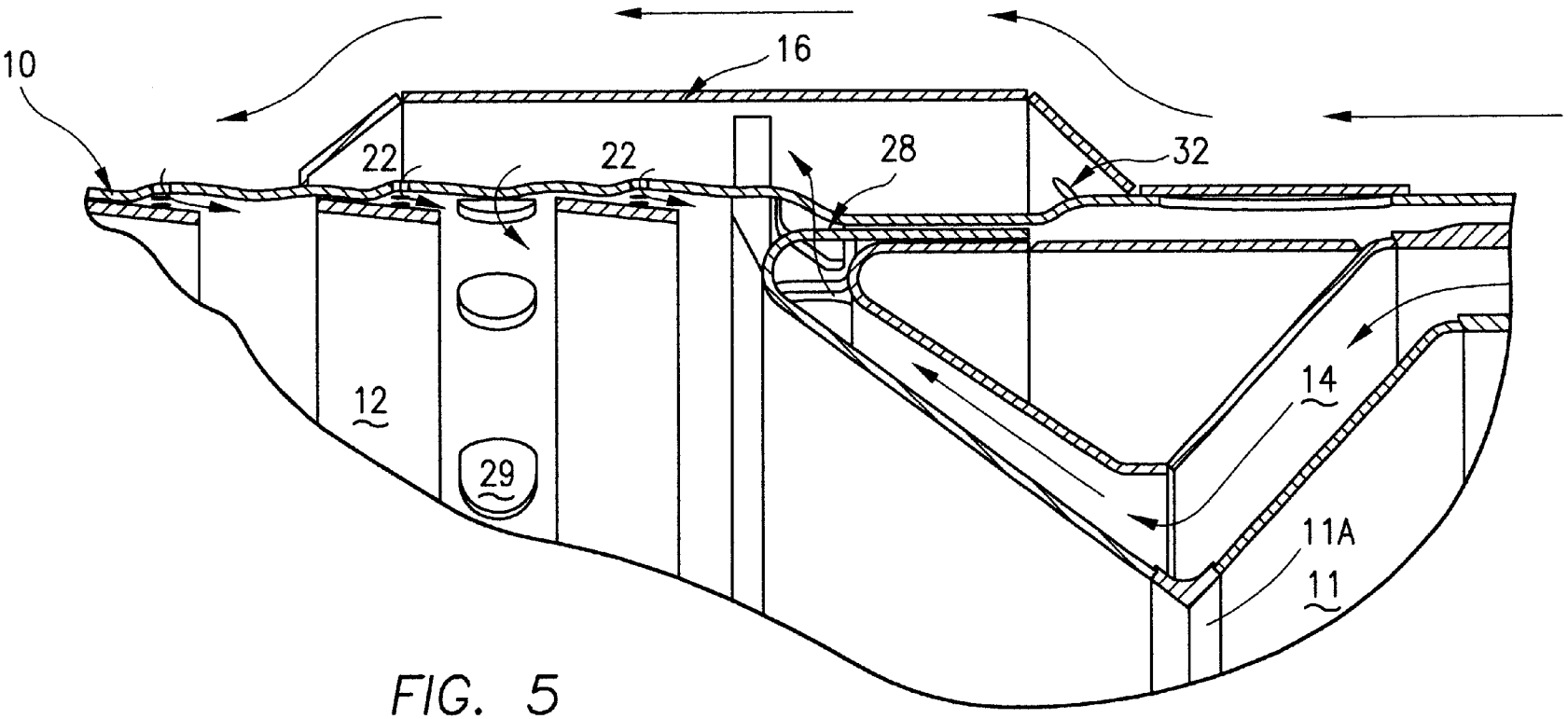
FIG. 5 shows a cross-sectional view, partially cut away of the cooling air passageway at the upstream end of the venturi in the annular bellyband chamber for receiving cooling air for introducing the air into the premix chamber.
Figure 6:
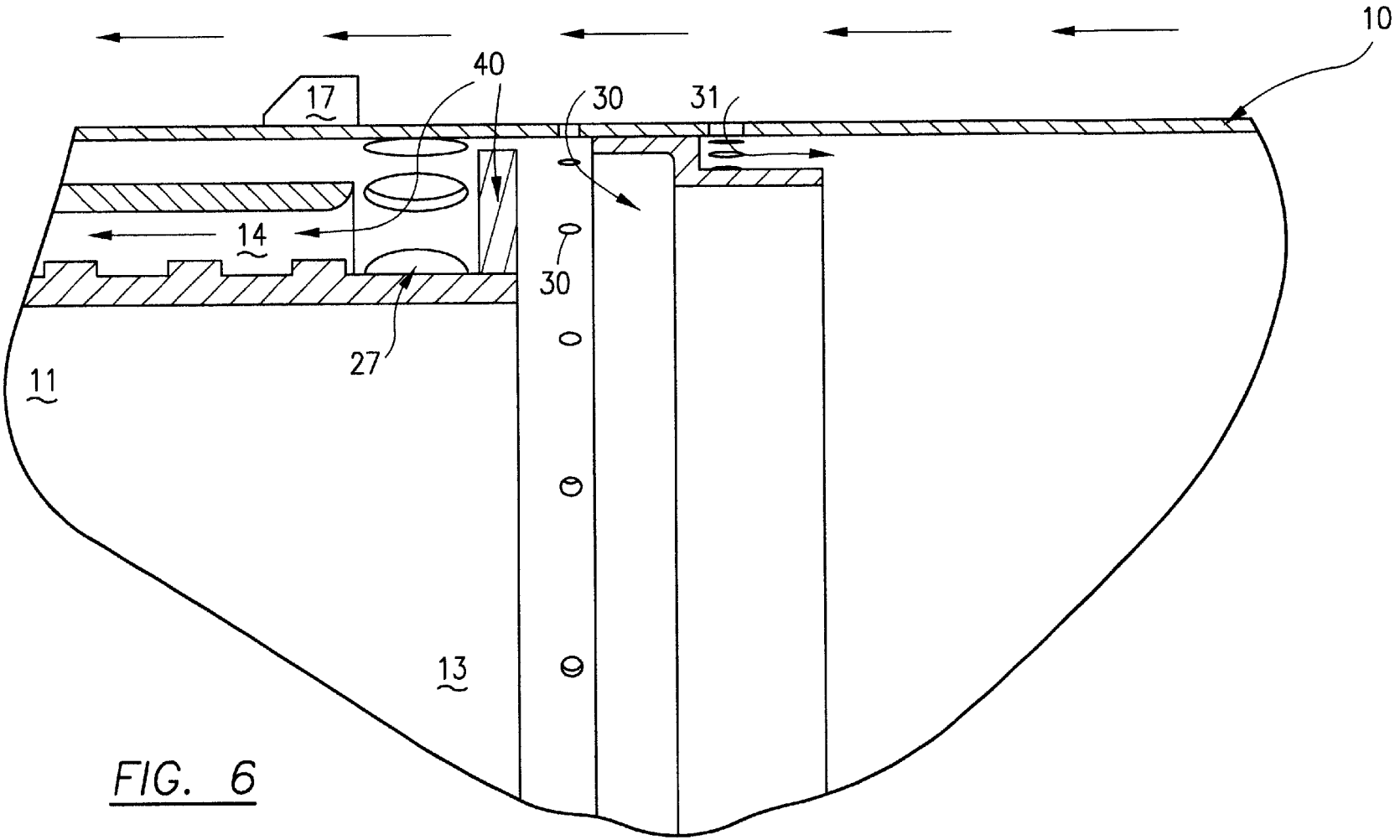
FIG. 6 is a cut away and enlarged view of the aft end of the combustion chamber wall in cross-section.

The outside of the combustor 10 is surrounded by a housing (not shown) and contains air under pressure that moves upstream towards the premix zone 12, the air being received from the compressor of the turbine. This is very high pressure air. The cooling air passageway 14 has air inlet apertures 27 which permit the high pressure air surrounding the combustor to enter through the apertures 27 and to be received in the first portion 45 of passageway 14 that surrounds the venturi 11. The cooling air passes along the venturi 11 passing the venturi converging and diverging walls and venturi throat 11*a*. Preheated cooling air exits through outlet apertures 28 which exit into an annular bellyband chamber 16 that defines a second portion 46 of the passageway 14. The combustor utilizes the cooling air that has been heated and allowed to enter into premix chamber 12 through apertures 29 and 22. Details are shown in FIGS. 5 and 6. Note that this is heated air that has been used for cooling that is now being introduced in the premix chamber, upstream of the convergent wall of the venturi and upstream of venturi throat 11*a*. Using preheated air drives the f/a ratio to a lean limit to reduce NOx while maintaining a stable flame.

Figure 4:
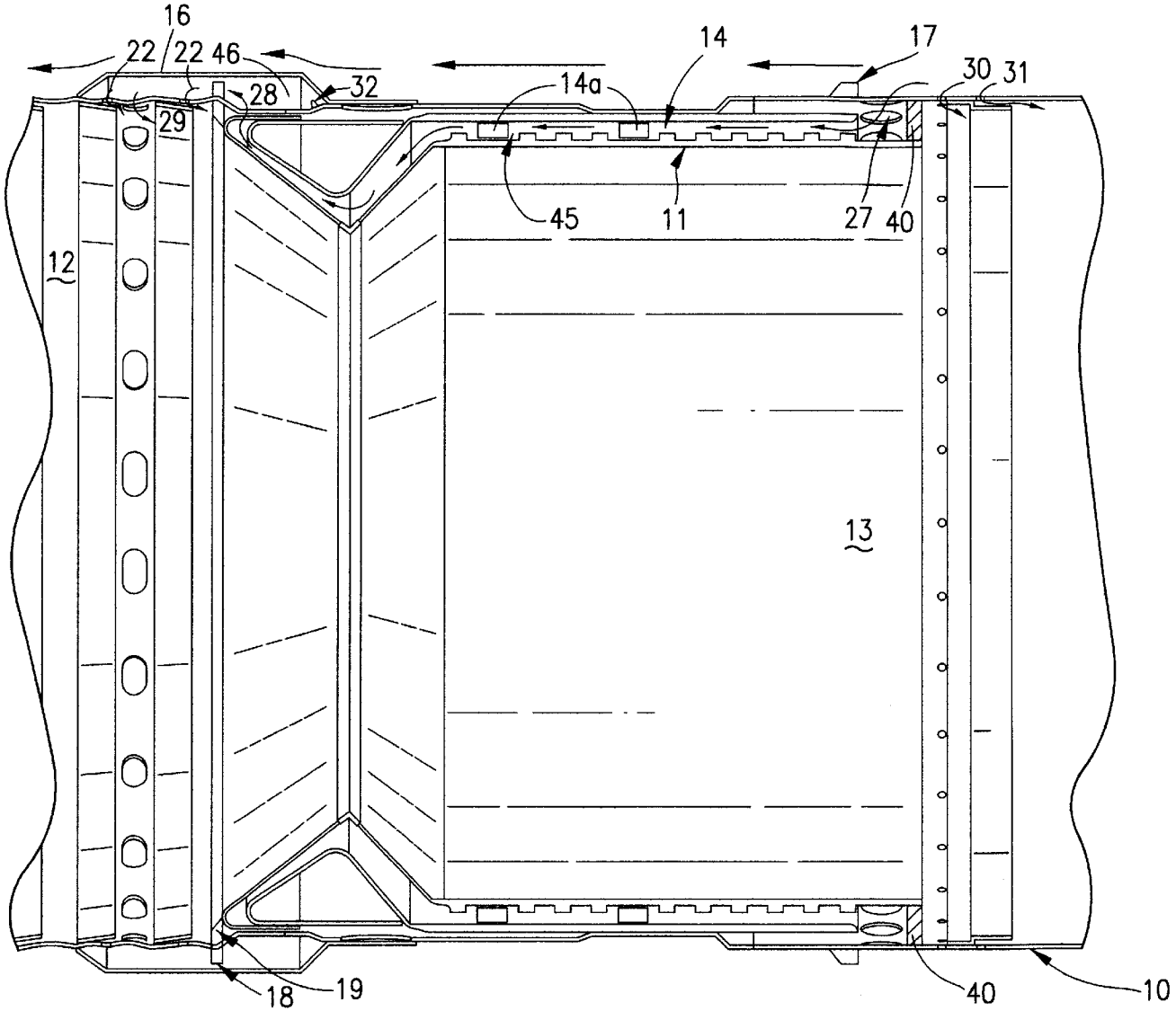
FIG. 4 shows a cut away version in cross section of the combustion chamber and venturi and portions of the premix chamber as utilized in the present invention.

Referring now to FIG. 4, the cooling air passage 14 includes a plurality of spacers 14*a* that separate venturi 11 from wall 11*b*. The bellyband wall 16 defines a radially outer boundary of the second portion 46 of the passageway 14 and provides a substantially annular chamber that allows the outside pressure air and the exiting cooling air to be received into the premix chamber 12. At the downstream end of the combustion chamber 13, defined by the annular aft end of venturi 11, there is disposed an annular air blocking ring 40 which prevents any cooling air from leaking downstream into the combustion chamber. This alleviates any combustion problems caused by the cooling air as delineated in the prior art discussed above.

Referring now to FIG. 5 the air passageway 14 is shown along the venturi section having the convergent and divergent walls and the throat 11*a* with cooling air passing through and exiting through apertures 28 that go into the air chamber formed by bellyband wall 16. Additional air under a higher pressure enters through apertures 32 and forces air including the now heated cooling air in passageway 14 to be forced through apertures 22 and 29 into the premix chamber 12.

FIG. 6 shows the aft end portion of the combustion chamber 13 and the end of venturi 11 that includes the blocking ring 40 that is annular and disposed and attached in a sealing manner around the entire aft portion of the venturi 11. The cooling air that enters into passageway 14 cannot escape or be allowed to pass into any portions of the combustion chamber 13. Note that some air is permitted into the combustor 10 well beyond combustion chamber 13 through apertures 30 to 31 which are disposed around the outside of the combustor 10 and for cooling the aft end of the combustor.

The invention also includes the method of improved cooling of a combustion chamber and venturi which allows the air used for cooling to increase the efficiency of the combustion process itself to reduce NOx emissions. With regards to the air flow, the cooling air enters the venturi outer passageway 14 through multiple apertures 27. A predetermined amount of air is directed into the passageway 14 by a element 17. The cooling air is forced upstream by blocking ring 40 which expands to contact the combustor 10 under thermal loading conditions. The cooling air travels upstream through the convergent/divergent sections of the first portion 45 of passageway 14 where it exits into the second portion 46 of passageway 14 through apertures 28 in the venturi 11 and the combustor 10. The cooling air then fills a chamber created by a full ring bellyband 16. Due to the pressure drop and increase in temperature that has occurred throughout the cooling path, supply air which is at an increased pressure is introduced into the bellyband chamber 16 through multiple holes 32. The cooling air passes around multiple elements 18 which are located throughout the bellyband chamber 16 for support of the bellyband under pressure. The cooling air is then introduced to the premix chamber through holes 22 and slots 29 in the combustor 10. Undesired leakage does not occur between the cooling passageway 14 and the premixing chamber 12 because of the forward support 19 which is fixed to the combustor 10 and venturi 11. The remainder of the cooling air not introduced to passageway 14 through apertures 27 passes over the element 17 and travels upstream to be introduced into the combustor 10 or cap 15. This air is introduced through multiple locations forward of the bellyband cavity 16.

It is through this process, rerouting air that was used for cooling and supplying it for combustion, that lowers the fuel to air ratio such that NOx is reduced without creating an unstable flame.

While the invention is been described and is known as presently the preferred embodiment, it is to be understood that the invention is not to be limited to the disclosed embodiment but, on the contrary, it is intended to cover various modifications and equivalent arrangements within the scope of the following claims.

What we claim is:

1. An improved low emission (NOx) combustor for use with gas turbine engine comprising:

a liner having a first generally annular wall and including a premix chamber for mixing fuel and air and a combustion chamber for combusting said fuel and air, said premix chamber in communication with said combustion chamber, said first generally annular wall having at least one first aperture and at least one second aperture, said second aperture being radially outward of said premix chamber;

a venturi having a second generally annular wall that includes a converging wall and a diverging wall, said converging wall connected to said diverging wall thereby defining a throat portion of the venturi, said throat portion being positioned between said premix chamber and said combustion chamber, said second generally annular wall being radially inward from said first generally annular wall and having an aft end adjacent said at least one first aperture;

a passageway for flowing cooling air through said venturi, said passageway extending from said at least one first aperture to said at least one second aperture, said passageway including a first portion radially inward from said first generally annular wall and radially outward from said second generally annular wall, and said passageway including a second portion radially outward from said first portion of said passageway, said second portion extending from said passageway first portion to said at least one second aperture, and said first aperture being radially outward from said first portion; and, a blocking ring extending from said aft end of said second generally annular wall to said first generally annular wall and sealingly connected thereto, said blocking ring preventing cooling air that is in said first portion of said passageway from flowing directly into said combustion chamber without flowing through said second portion of said passageway;

wherein said passageway is in fluid communication with said at least one first aperture and said at least one second aperture, said passageway communicates with said premix chamber through said at least one second aperture, and cooling air, after being heated by cooling said venturi, exits from said passageway into the premix chamber thereby increasing the efficiency of the combustion process and reducing NOx emissions.

2. The low emission (NOx) combustor of claim 1 further including a substantially annular bellyband wall radially outward from the first annular wall, and at least one-third aperture in said first annular wall, said first portion of said passageway communicating with said second portion of said passageway through said third aperture, wherein said bellyband wall defines a radially outer boundary of the second portion of the passageway.

3. The low emission (NOx) combustor as in claim 2 wherein said at least one first aperture comprises a plurality of first apertures spaced circumferentially about the first annular wall, and each of said first apertures is radially outward of the first portion of the passageway.

4. The low NOx emission combustor of claim 3 wherein said at least one second aperture comprises a plurality of second apertures spaced circumferentially about the first generally annular wall, and each of said second apertures is radially outward of the premix chamber.

5. The low NOx emission combustor as in claim 4 wherein said at least one-third aperture comprises a plurality of third apertures spaced circumferentially about the first annular wall, and each of said third apertures is radially outward of the venturi.

* * * * *